US006595838B1

(12) United States Patent
Palushi et al.

(10) Patent No.: US 6,595,838 B1
(45) Date of Patent: Jul. 22, 2003

(54) WOOD FLOOR SANDING MACHINE

(75) Inventors: Simon Palushi, Shelby Township, MI (US); Steven L. Permut, Huntington Woods, MI (US)

(73) Assignee: OnFloor Technologies, LLC, Newburgh, NY (US)

( * ) Notice: Subject to any disclaimer, the term of this patent is extended or adjusted under 35 U.S.C. 154(b) by 1 day.

(21) Appl. No.: 09/911,249

(22) Filed: Jul. 23, 2001

(51) Int. Cl.[7] ..... B24B 23/03
(52) U.S. Cl. ..... 451/350; 451/259
(58) Field of Search ..... 451/350, 351, 451/353, 259, 270, 271, 268, 269, 340, 344

(56) References Cited

U.S. PATENT DOCUMENTS

| | | | | | |
|---|---|---|---|---|---|
| 1,601,087 | A | | 9/1926 | Simpson | |
| 1,919,389 | A | * | 7/1933 | Myers | 144/119.1 |
| 1,928,390 | A | * | 9/1933 | Myers | 15/49.1 |
| 1,988,193 | A | * | 1/1935 | Edstrom | 15/98 |
| 2,171,060 | A | * | 8/1939 | De Spirt | 299/41.1 |
| 2,300,138 | A | * | 10/1942 | Steele | 15/49.1 |
| 3,098,329 | A | | 7/1963 | Doran | |
| 3,128,581 | A | | 4/1964 | Tosetti | |
| 3,169,262 | A | | 2/1965 | Allen et al. | |
| 3,354,488 | A | | 11/1967 | Blide | |
| 3,721,048 | A | | 3/1973 | Rand | |
| 4,097,950 | A | * | 7/1978 | Satterfield | 15/385 |
| 4,150,456 | A | | 4/1979 | Alvarez et al. | |
| 4,182,001 | A | | 1/1980 | Krause | |
| 4,186,967 | A | * | 2/1980 | Kuhmonen | 299/25 |
| 4,319,434 | A | * | 3/1982 | Brejcha | 15/49.1 |
| 4,709,510 | A | | 12/1987 | Giovanni et al. | |
| 4,862,548 | A | * | 9/1989 | Sergio | 15/49.1 |
| 4,862,766 | A | | 9/1989 | Molders | |
| 5,054,245 | A | * | 10/1991 | Coty | 15/98 |
| 5,170,595 | A | * | 12/1992 | Wiand | 15/230 |
| 5,209,961 | A | | 5/1993 | Yokoi | |
| 5,224,301 | A | | 7/1993 | Tasikas | |
| 5,314,386 | A | | 5/1994 | Eide et al. | |
| 5,377,375 | A | | 1/1995 | Holman et al. | |
| 5,416,943 | A | * | 5/1995 | Weltikol et al. | 15/49.1 |
| 5,439,413 | A | | 8/1995 | Lagler | |
| 5,454,751 | A | | 10/1995 | Wiand | |
| 5,507,061 | A | | 4/1996 | Miyazaki | |
| 5,548,860 | A | * | 8/1996 | Weltikol et al. | 15/49.1 |
| 5,637,032 | A | | 6/1997 | Thysell et al. | |
| 5,765,250 | A | * | 6/1998 | Lee | 15/49.1 |
| 5,788,561 | A | * | 8/1998 | Pearlman et al. | 125/13.01 |
| 5,829,095 | A | | 11/1998 | Legatt et al. | |
| 5,863,241 | A | | 1/1999 | Rottschy | |
| 5,875,506 | A | | 3/1999 | Plazanet | |
| 5,905,927 | A | | 5/1999 | Inoue et al. | |
| 6,148,476 | A | | 11/2000 | Legatt et al. | |
| 6,238,277 | B1 | * | 5/2001 | Duncan et al. | 451/271 |
| 6,331,138 | B1 | * | 12/2001 | Witters et al. | 451/259 |

OTHER PUBLICATIONS

Alto, American Sanders Technology, Alto U.S. Inc. 390 South Woods Mills Road, Chesterfield, MO 63017–3433 Catalog.

Lagler, Palo Duro Hardwoods, Inc. 4800 Lima Street, Denver Colorado 80239 Catalog.

Cimex International, 100 Stradtman Street, Buffalo New York 14206 Catalog.

Innovatech, 19722 144th Avenue, NE Woodinville, WA 98072 Catalog.

* cited by examiner

*Primary Examiner*—Joseph J. Hail, III
*Assistant Examiner*—David B. Thomas
(74) *Attorney, Agent, or Firm*—Reising, Ethington, Barnes, Kisselle, P.C.

(57) ABSTRACT

A power sanding machine (10) has three circumferentially spaced cogged belts (40) that are under tension via bearings (36) to drive three discs (52). A grounded vacuum (16) with a metal canister (74) is mounted on the operating handle (14).

15 Claims, 7 Drawing Sheets

WOOD FLOOR SANDING MACHINE

TECHNICAL FIELD

The field of this invention relates to wood floor sanding machines.

BACKGROUND OF THE DISCLOSURE

Hardwood floors have long been a desirable trait in a home. However, sanding and refurbishing a hardwood floor is one of the more difficult do-it yourself tasks for a homeowner.

The present sanding machines on the market commonly have a single belt drive all three sanding discs which creates a side torque that drives the machine to one side as it sands the floor. The operator then needs to always counter the torque which promotes an uneven surface finishing and fatigue on the operator for larger sanding jobs.

Many machines also have higher operating speeds which allow little error in operating the machines. The high operating speeds can quickly cause gouging and knicks in the wood floor without having time to control or eliminate these gouges. Furthermore, the high operating speeds produce significant amount of noise.

Attempts have been made to increase the sanding force of the discs by increasing the weight of the sander. These weights are obtrusive horseshoe shaped steel members that are mounted on top of the sander housing. The external weights require an extra fastening device and if not tightly mounting the weights, extra chatter and vibration may occur.

These sanding machines also have a housing edge which is widely spaced from the operating sanding discs. This prevents the machine to sand close to walls. Furthermore the housing may have a high periphery which prevents it from intruding under the toe recess under many kitchen cabinets. As a result, even after adding a shoe molding to the edge of the floor, an unsanded edge may be showing. Therefore, additional smaller edge sanders need to be extensively used to approach the edge of the floor which further make the sanding process difficult.

Furthermore, the sanding creates great amount of sawdust which needs to be controlled. The sawdust if not controlled can fill the room creating a mess and interfering with the visibility of the floor as it is being sanded. Secondly, uncontrolled sawdust, particularly when air born, may under certain circumstances be combustible from sparks or other ignition sources. If a vacuum is difficult to use on a floor sander, complacency is promoted in allowing loose sawdust to accumulate.

Furthermore, for do-it yourself applications, an operator often leases or rents a machine which therefore requires the operator to carry the machine from the rental outlet. If the machine is not easily disassembled to easily carried components, the weight of the machine may cause difficulty for the operator to transport the sander between the rental place and his home.

What is needed is a floor sander that can approach an edge of a floor within the distance of an ordinary shoe molding while reducing noise, that increases control and ease of use, reduces saw dust, and provides other conveniences for making a do it yourself operation feasible.

SUMMARY OF THE DISCLOSURE

In accordance with one aspect of the invention, a power sander for a wood floor includes a housing, and a motor mounted to the housing and having a centrally positioned downwardly extending drive shaft. An inner bowl member is positioned within the housing and is rotatably mounted on the drive shaft to allow rotation of the inner bowl with respect to both the housing and drive shaft. A plurality of pulleys are circumferentially spaced about the drive shaft and are rotatably connected to the inner bowl member. The axis of rotation of each pulley is parallel to the axis of rotation of the drive shaft. Each pulley constructed to have sander discs mounted thereon. A plurality of belts, with each belt preferably having a cogged inside and mounted about one pulley and engageably driven by the drive shaft. The drive shaft and said pulleys having respective cogged peripheries for creating a positive engagement with said inner side of the respective belts. A plurality of pulley tensioners engage the outer side of a respective belt with the outer side preferably being flat and frictionally engaged by the pulley tensioners in the form of bearings.

The belts are vertically spaced with respect to the drive shaft at a vertical position adjacent from one another. Each respective pulley is respectively vertically positioned to engage its respective belt horizontally from the engaging vertical position on the drive shaft. Each tensioner also is vertically positioned to a proper height to operably engage its respective belt.

The housing is preferably bell shaped with a downwardly extending side wall and connectable to a vacuum motor for suction of saw dust up through the bell shaped housing. The housing has an aperture for connection to a vacuum hose for allowing vacuuming of sawdust up through the housing and through the aperture. A weighted metal plate is attached to an inner bowl member, said weighted metal plate having apertures for allowing said pulley to extend therethrough. The plate has an outer periphery spaced from said side wall of said housing to define a path for the vacuuming of said saw dust.

It is desirable that a weighted plate is mounted to the inner bowl and has notches at its outer periphery to create widened gaps with the housing to increase air flow therebetween. It is also preferred that the housing has its side walls spaced within ⅜ inches from a sanding disc edge. The housing has handles mounted thereon near a front and rear portion thereof and extending upwardly therefrom. The housing also has a plurality of quick connect pins that removably connect the housing to the operating handle. In accordance with another embodiment of the invention, the center drive shaft has a gear section, these gears are circumferentially spaced about said drive shaft and are rotatably mounted on the inner bowl member in a coplanar fashion and operably engage said center gear section of the drive shaft. The gears having respective pulley sections affixed thereto with the pulley sections being coplanar with each other. The plurality of pulleys are coplanar with each other and with the pulley sections. The belts are also coplanar and engage a pulley section of the respective gear and the pulleys.

In accordance with another aspect of the invention, a vacuum cleaner is mounted to the operable handle. A vacuum hose operably extends from the vacuum cleaner and is resiliently flexible and stretchable from a rest length to an increased length. The distal end of the hose having a shaped nozzle that can receive a hose coupling on the housing allowing the hose to be directly connected to the hose coupling without removal of said shaped nozzle for vacuuming sawdust out of the housing, and with said hose being detachable from said hose coupling to allow said shaped nozzle to be operably used. The vacuum is grounded to ht power sanding machine and preferably has a metal canister.

BRIEF DESCRIPTION OF THE DRAWINGS

Reference now is made to the accompanying drawings in which.

DETAILED DESCRIPTION OF THE PREFERRED EMBODIMENT

Figure 1:
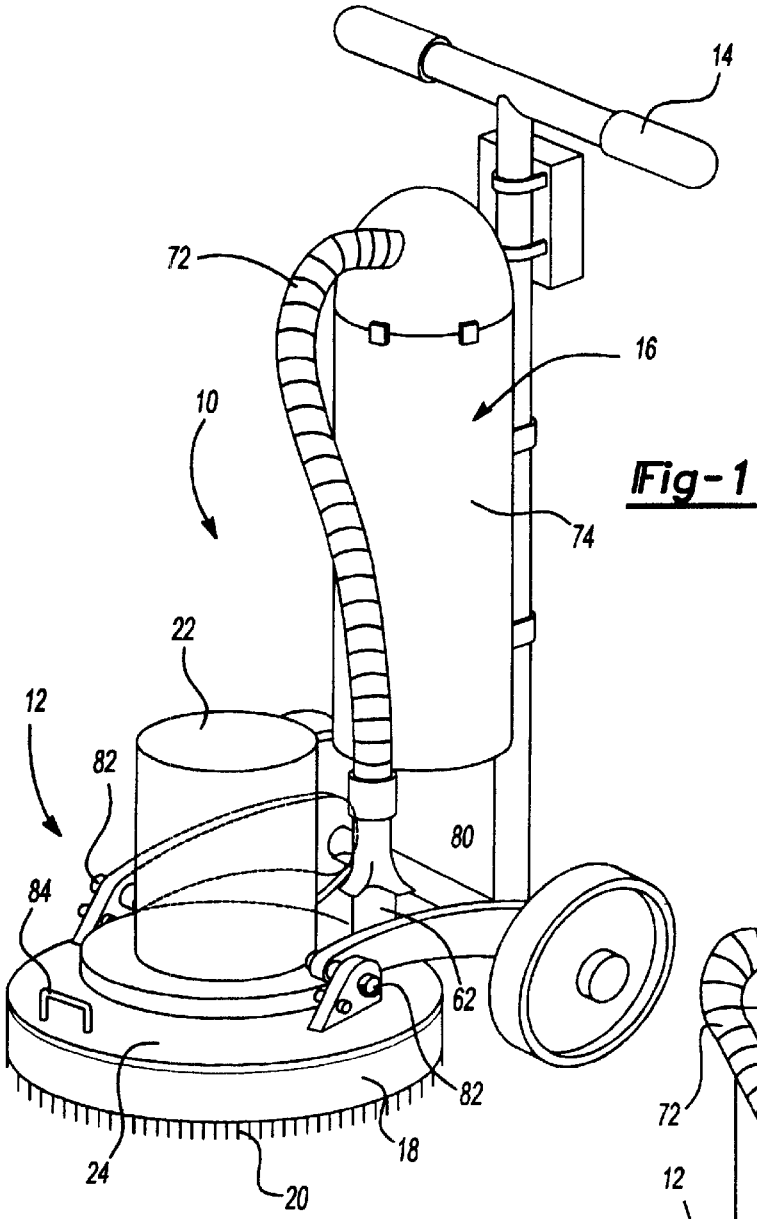
FIG. 1 is a front perspective view of a floor sander in accordance with one embodiment of the invention.

Referring now to FIG. 1, a floor sander 10 has a housing 12 connected to an operating handle 14. A vacuum 16 is mounted on the operating handle. The housing 12 has a generally bell shape with a side peripheral section 18 that mounts a peripheral brush 20. A motor 22 is mounted on the top portion 24 of the housing 12.

Figure 9:
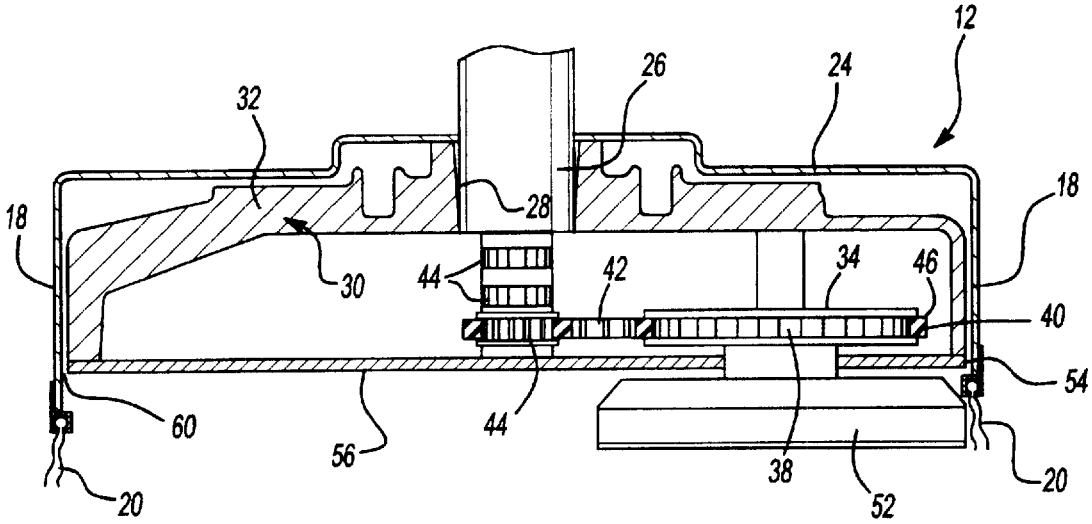
FIG. 9 is a cross sectional view of the housing taken along lines 9—9 shown in FIG. 1.

As shown in FIG. 9, the motor has a drive shaft 26 that extends down through the top portion 24 of the housing. The motor 22 is electric and is operably connected to a power cord (not shown) that can conventionally be plugged into a 110 volt receptacle.

Figure 5:
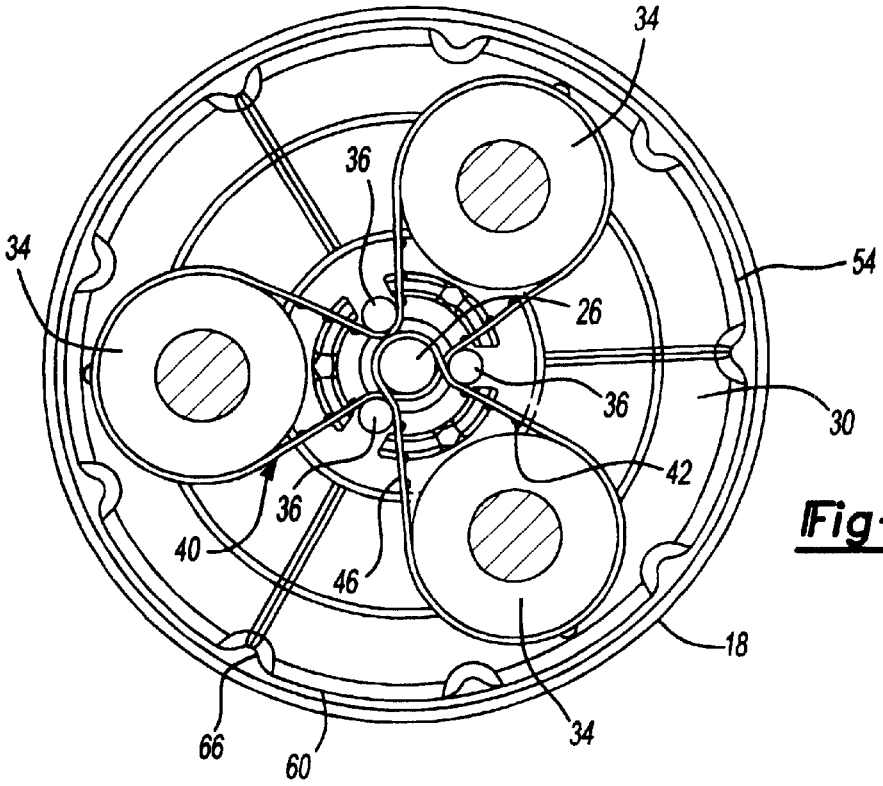
FIG. 5 is a cross sectional view taken along lines 5—5 shown in FIG. 3.
Figure 7:
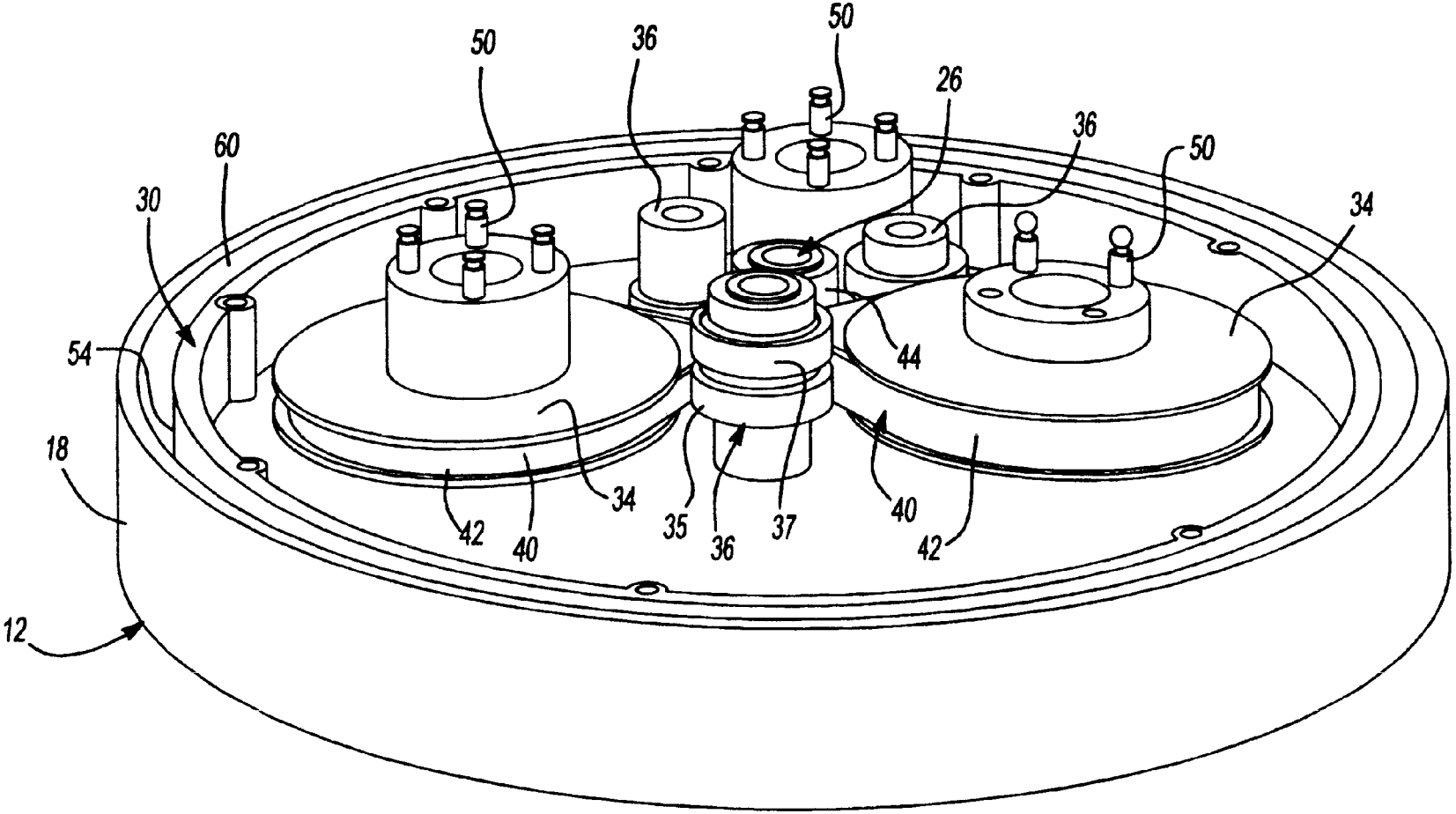
FIG. 7 is a bottom perspective view of the housing and inner bowl with the discs and belts removed for illustration purposes.

The drive shaft also extends through a center hole 28 of an inner bowl 30. The inner bowl is rotatable with both the housing 12 and the drive shaft 26. The bowl has a top portion 32 which rotatably mounts three pulleys 34 and three bearings 36 as best shown in FIGS. 5, 7, and 9. The pulleys 34 have a cogged periphery 38 which engages a respective cogged inner wall or inside side 42 of a belt 40. The cogged inner wall 42 of the belt also engages a central cogged pulley 44 affixed to the drive shaft 26. As the drive shaft rotates, the belt has a positive engagement with both the cogs 44 and the pulleys 34. As shown, three pulleys are each spaced about the drive shaft 120 degrees from each other.

Figure 8:
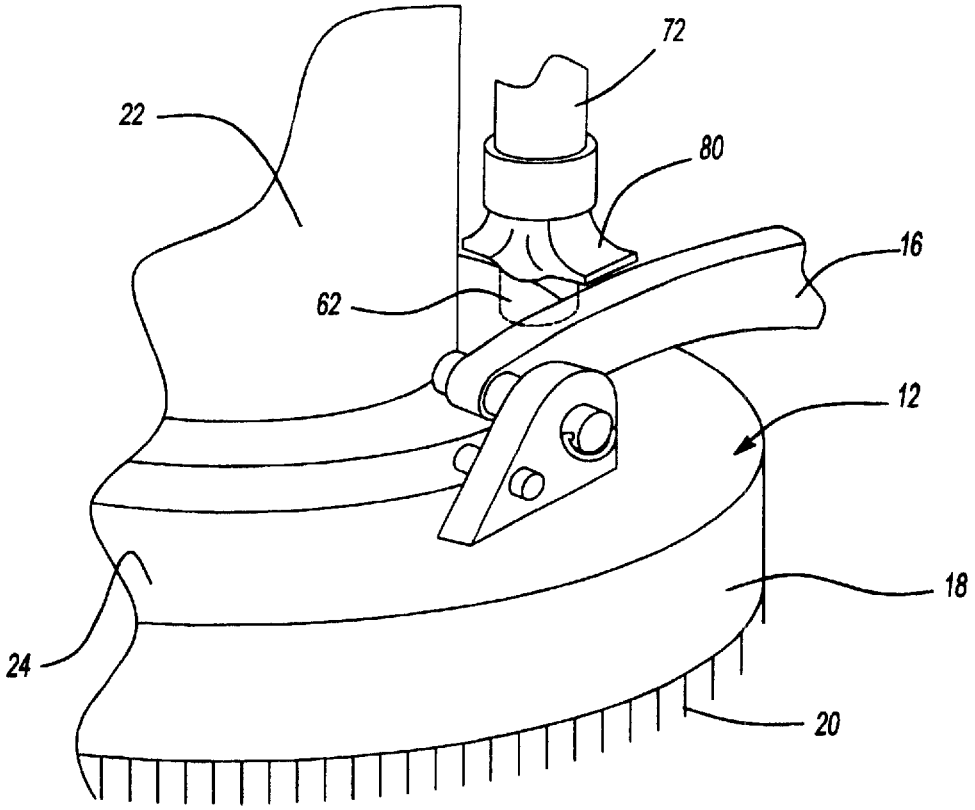
FIG. 8 is a fragmentary upper perspective view of the housing illustrating the lift handles, the vacuum hose connection, and the quick connect fitting between the housing and the operating handle.

The bearings 36 on the other hand are positioned to frictionally engage a flat outerside 46 of the belt 40. Each bearing is also positioned to place tension of a respective belt 40 and to provide enhanced engagement area between the belt and the pulleys 34 and cogs 44. As best shown in FIG. 5, each belt is actually tensioned by two bearings 36 which provide a pinching of the belt 40 about cog 44. The belts are vertically positioned at different heights from each other to provide non-interference. As shown in FIG. 8 the three cogs 44 are vertically positioned to engage a respective belt 40. The bearings 36 are split into an upper and lower section 35 and 37 which each independently rotate with respect to the two adjacent belts that engage the bearing as best shown in FIG. 7.

Figure 3:
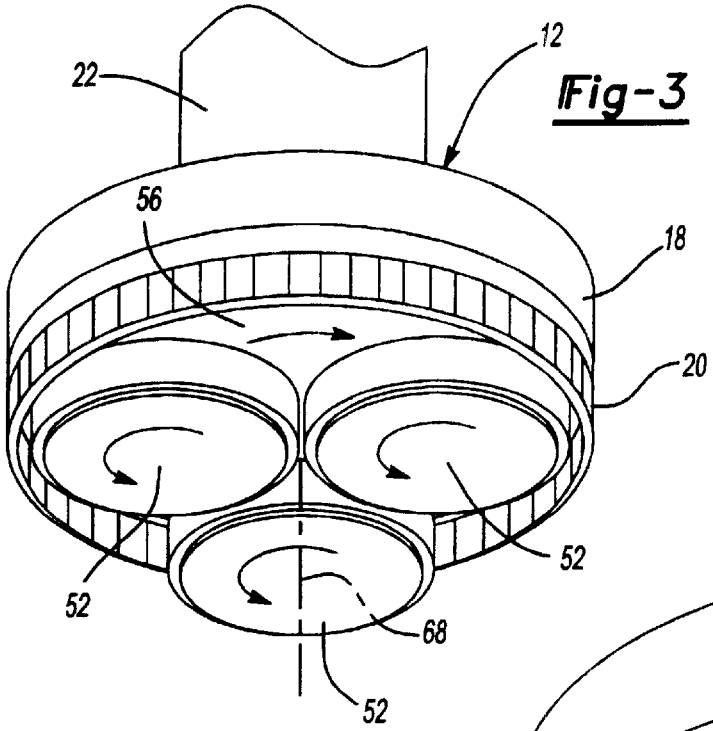
FIG. 3 is bottom perspective view of the embodiment shown in FIG. 1.
Figure 4:
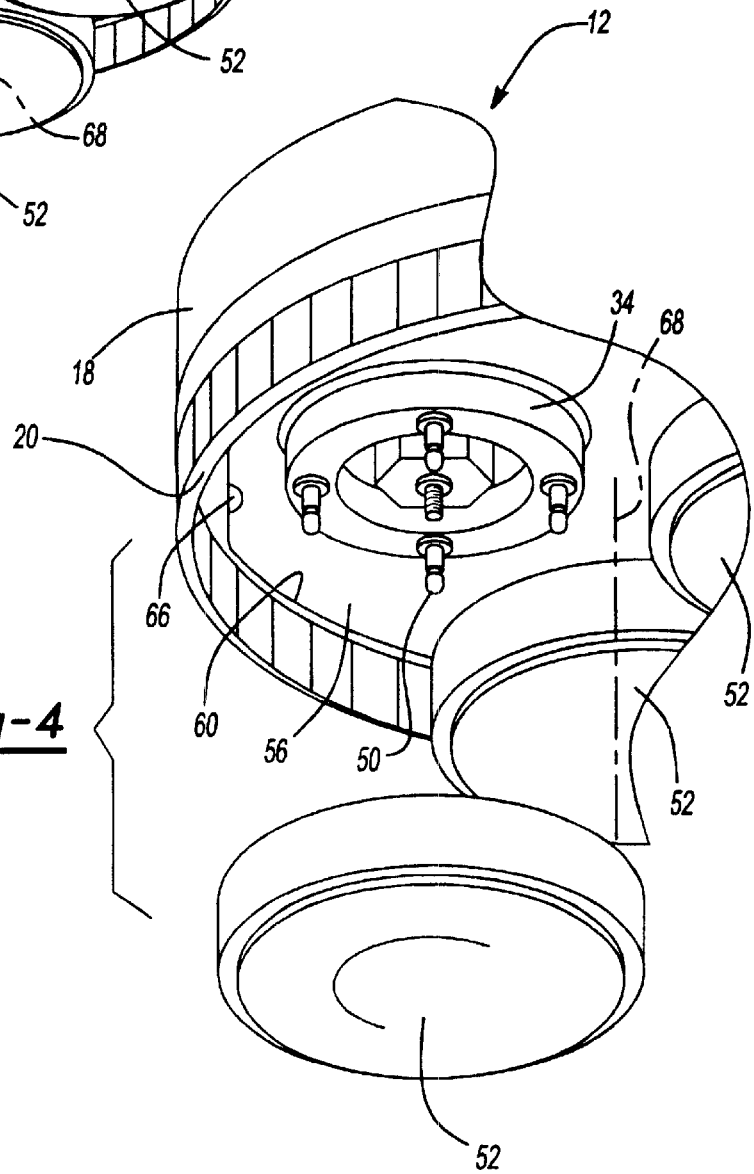
FIG. 4 is a lower perspective view showing one disc removed.

As shown in FIGS. 3 and 4, the pulleys have a mounting system 50 for engaging sanding discs 52. The sanding discs are sized to approach the outer periphery 18 of the housing 12. A peripheral brush 20 comes within one inch and preferably within ⅜ inches from the sanding disc 52. In this fashion, the power sander can sand floors to within the edge of the floor that will normally be then be covered by conventionally dimensioned shoe molding.

As the discs are driven by the motor in the direction as shown in FIGS. 3 and 4, the torque exerted by the rotation of the discs on the floor is greater at distances farther away from the central axis 68 of the drive shaft 26. As such, the sanding discs torque tends to pull and rotate the inner bowl in the direction shown in FIGS. 3 and 4. Hence the inner bowl 30 and the assembly of pulleys 34 and discs 52 counter rotate with respect to the rotation of the individual pulleys 34 and discs 52. The equal circumferential spacing of the pulleys 34 and discs 54 about the central drive shaft 26 eliminates virtually all side torque forces and provides for a balanced machine.

The inner bowl 30 has a side periphery 54 that mounts a steel weight plate 56. The plate has a dual purpose for reducing wood dust from intruding into the bowl 32 where it may interfere with the operating cogs 44, pulleys 34, and belts 40 and for adding the proper amount of weight to the sander to enhance sanding forces and balance to the machine. The balance significantly reduces chatter and provides for a faster machine. It can be easily appreciated, that chatter besides reducing control of the machine can put gouges into a floor surface and ruin the objective of a smoothly sanded floor. With the balance, built in weight and lack of sideways torque, the machine can operate with disc speeds as low as 350 rpms and still provide for effective sanding of wood floors.

Figure 6:
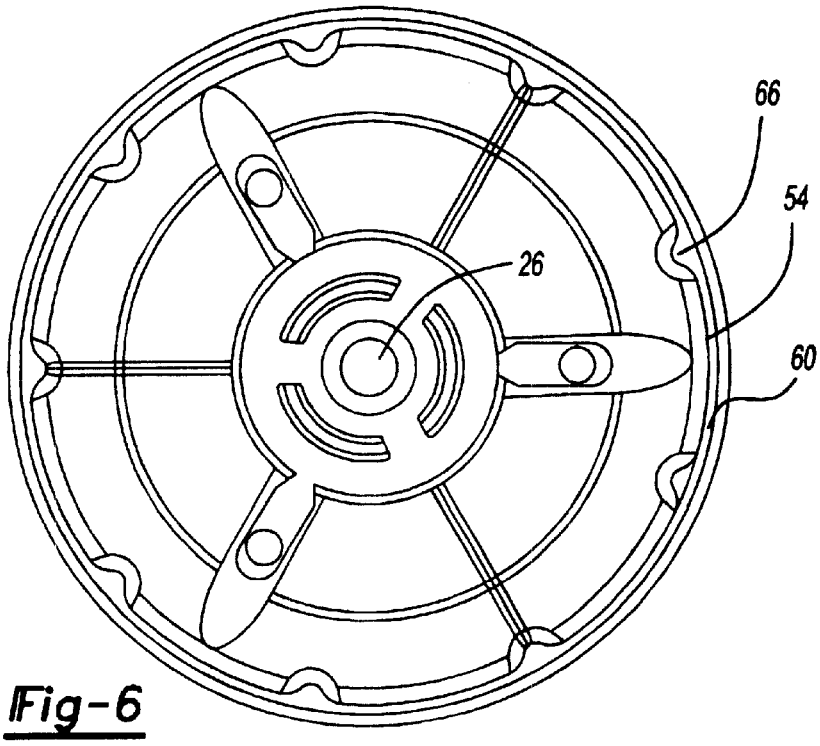
FIG. 6 is a cross sectional view taken along lines 6—6 shown in FIG. 3.

There is a gap 60 between the inner bowl 32 and the outer bowl 18 to allow a vacuum passage to an outlet nozzle 62 for the vacuum cleaner 16. As shown in FIG. 6, the inner bowl periphery 54 may have notches 66 to increase and assure air flow for the vacuum.

The vacuum 16 has a bottom mounted motor 70 and an inlet hose 72 mounted at a top portion of a vertically oriented canister housing 74. A vacuum bag 76 is also mounted in the vertically oriented canister 74. In this way, gravity also assists in settling the wood dust particles to the bottom of the bag 76 and to reduce airborne particulate. In addition, the canister 72 is made of metal and grounded to the machine such that the probability of an static spark occurring is reduced. Sparks should be reduced near wood dust and airborne wood particulate.

A flexible stretchable hose 72 connects the vacuum 16 to the housing 12. The hose can resiliently stretch well over triple its initial rest length. The end 78 of the hose connects to the nozzle 62. As best shown in FIG. 9, the end 78 has a brush or other shaped nozzle attachment 80 affixed thereto can be used by an operator as an independent vacuum cleaner to clean up saw dust and other particulates.

However, when the sanding machine 10 is operating, the hose end 78 with the attachment 80 still affixed thereto can be operably connected to the nozzle 62. The attachment 80 is shaped to receive the nozzle 62 and let the nozzle extend up to the hose and bypass the attachment 80 effective shape. In this way, the vacuum can be easily used both with the sanding machine and as an effective cleanup tool independent of the sanding machine. The machine 10 has a power switch which allows independent actuation of the vacuum without the actuation of the pulleys 34 and discs 54.

The motor for the vacuum is a two speed motor that has one speed for use during operation of the discs 52 and another higher speed when only the attachment 80 is being used for cleanup. The two speed motor allows for less noise during usage of the sanding machine. The low rpms of the power sanding discs and the lower vacuum operation provides for a sanding machine that is as quiet as a conventional wet/dry vacuum cleaner.

For ease of transportation, the housing 12 can easily disengage from and re-engage to the operating handle 14 via quick connect coupling pins 82. Furthermore to aid in transportation, the housing 12 has separate lifting handles 84 at its front and back.

Figure 10:
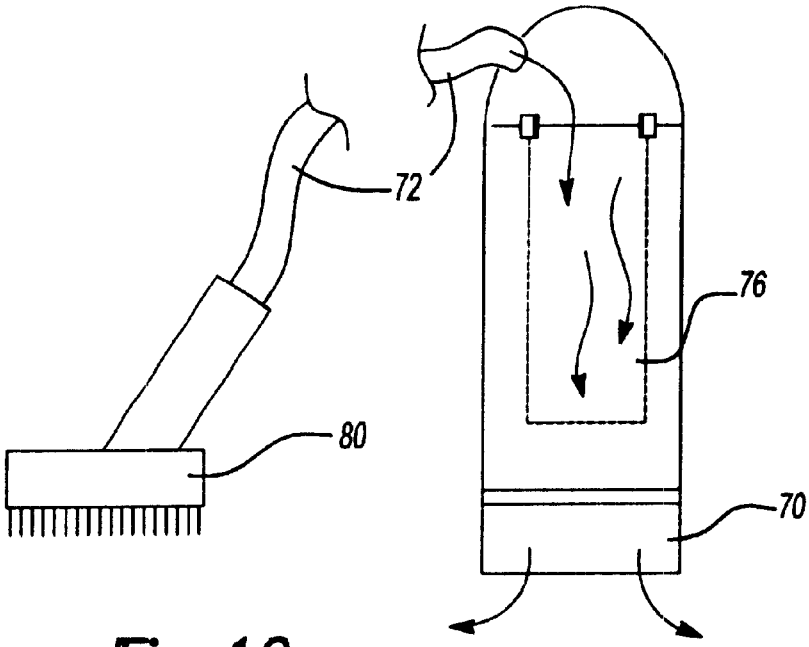
FIG. 10 is a schematic internal view of the vacuum that is mounted on the operating handle.
Figure 11:
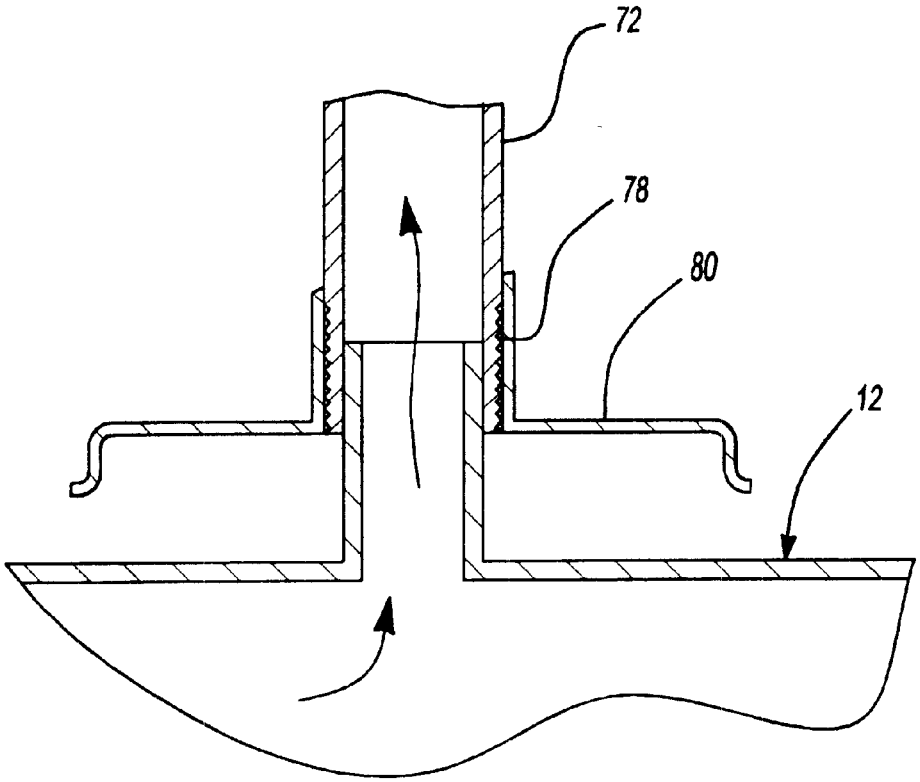
FIG. 11 is a segmented view illustrating the connection of the hose to the housing.
Figure 12:
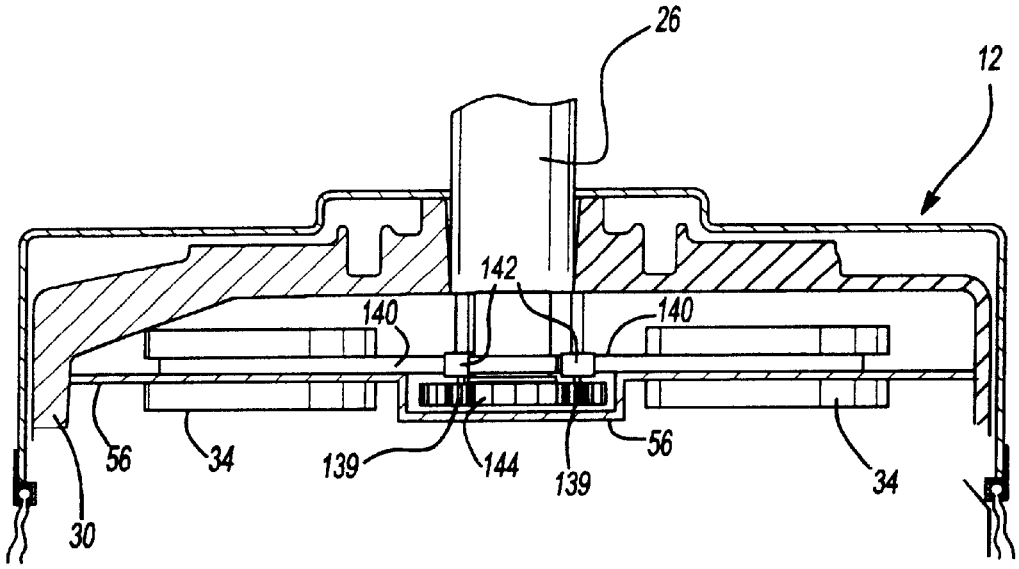
FIG. 12 is a segmented side elevational view of a second embodiment.
Figure 13:
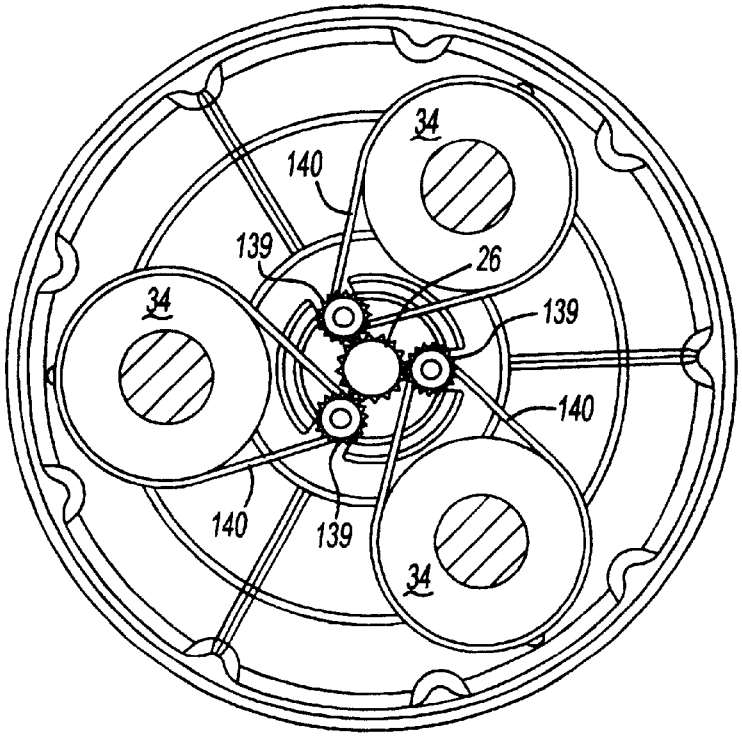
FIG. 13 is a bottom plan and partially exploded view of the embodiment shown in FIG. 12.
Figures 1, 2:
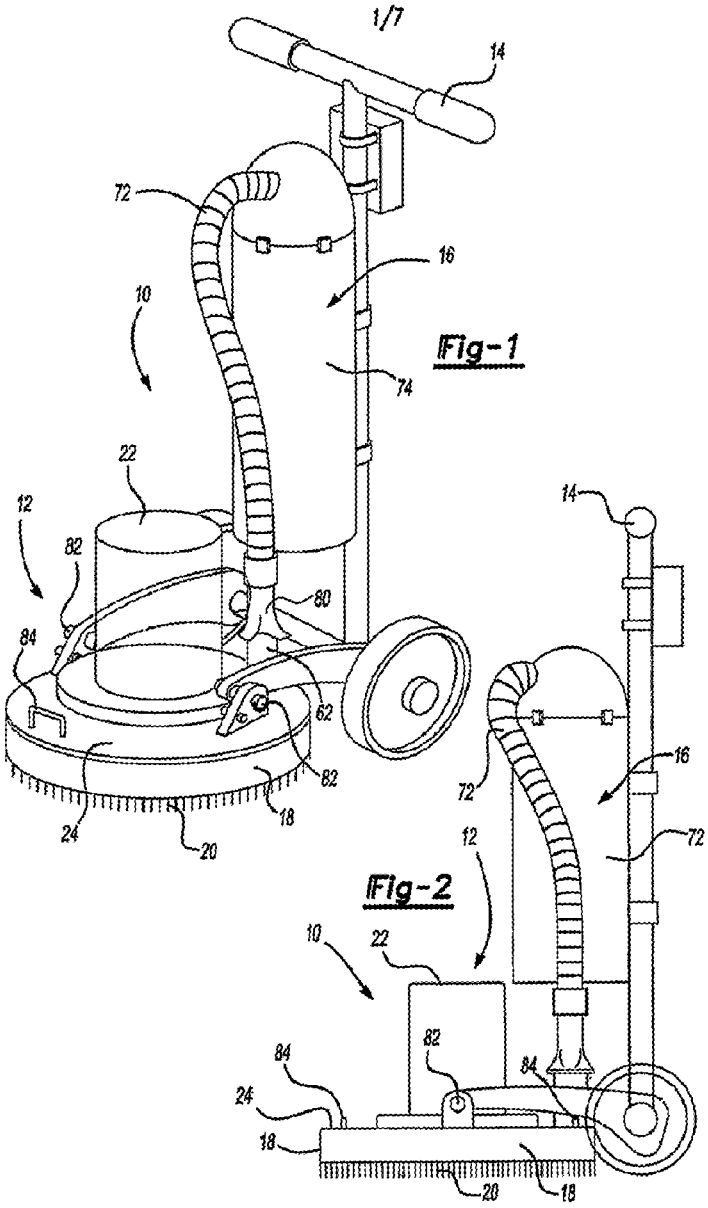
Figure 1:
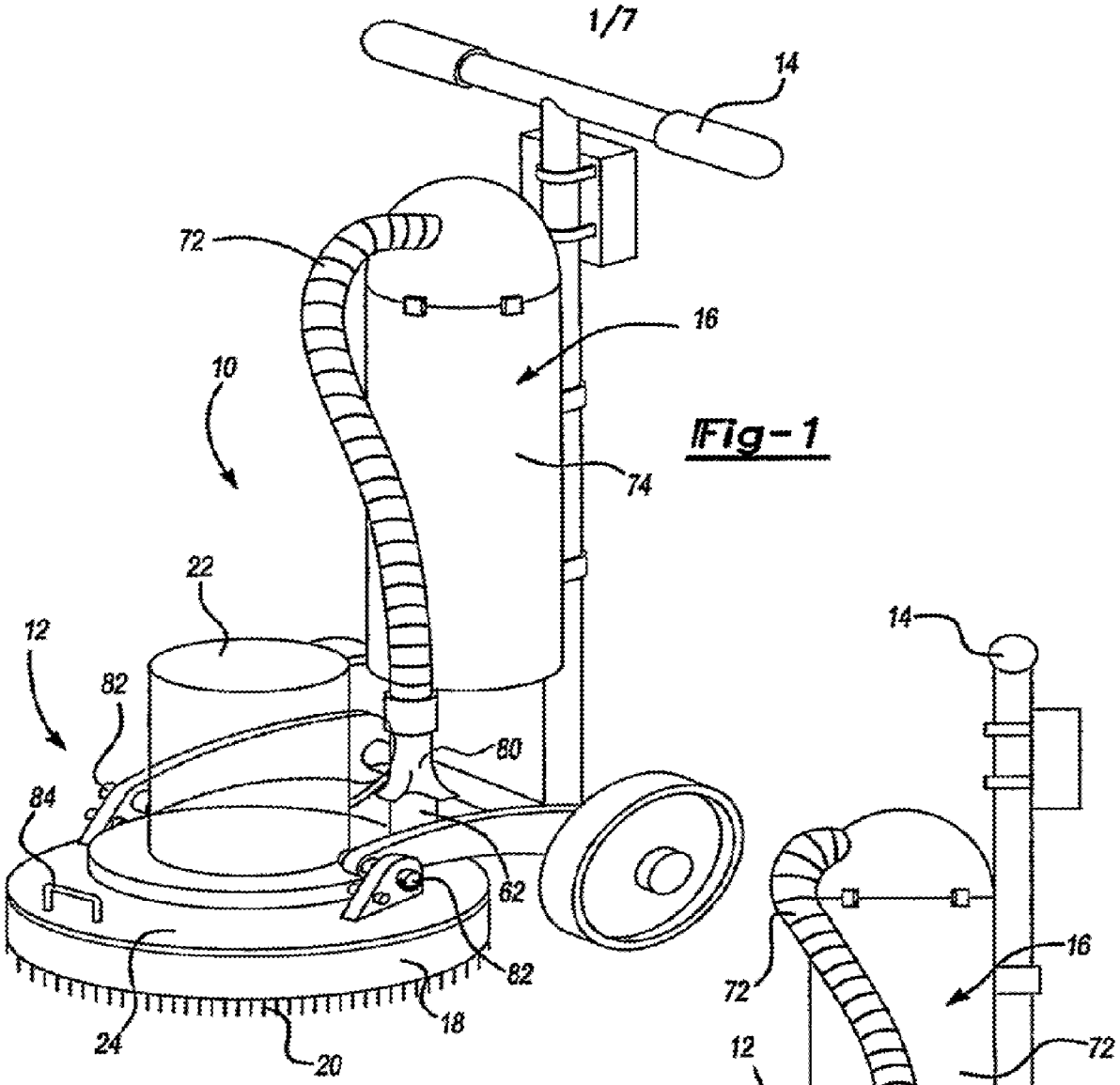
Figure 2:
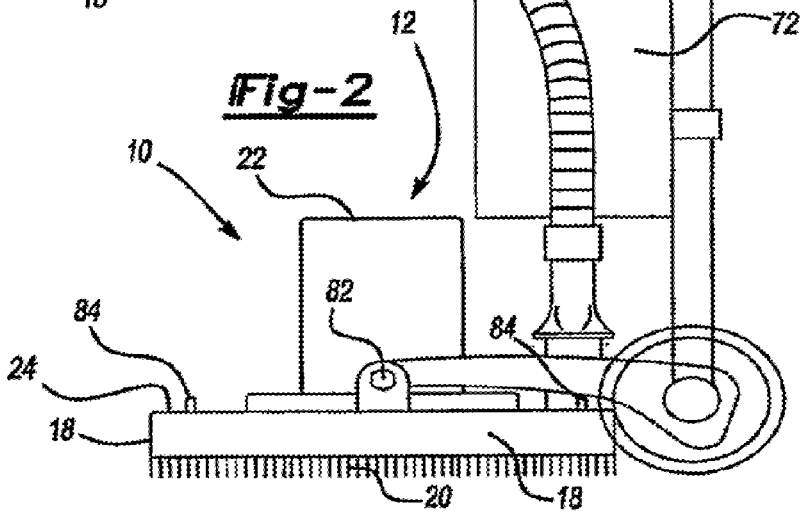

A second embodiments is of the machine is disclosed in FIGS. 10 and 11. This embodiment has three coplanar belts 140 that are mounted on pulleys 34 and smaller drive pulleys 142. The three coplanar drive pulleys 142 are driven via gear teeth 139 vertically spaced from the belt engaging section to a drive cog 144 on drive shaft 26. The three drive pulleys 142 are equally circumferentially spaced about the drive shaft 26. The belts may be optionally tensioned by bearings (not shown) on the exterior side of the belts in the same fashion as the first described embodiment. In this way, all three belts are coplanar which provides for a more compact lower profile housing 18.

Variations and modifications are possible without departing from the scope and spirit of the present invention as defined by the appended claims.

The embodiments in which an exclusive property or privilege is claimed are defined as follows:

1. A power sander for a wood floor comprising:

a housing;

a motor mounted to said housing and having a centrally positioned downwardly extending drive shaft;

an inner bowl member positioned within said housing and rotatably mounted on said drive shaft to allow rotation of said inner bowl with respect to both said housing and drive shaft;

a plurality of pulleys circumferentially spaced about said drive shaft and rotatably connected to said inner bowl member;

the axis of rotation of each pulley being parallel to the axis of rotation of said drive shaft;

each pulley constructed to have sander discs mounted thereon;

a plurality of belts, each belt mounted about the one pulley and engageably driven by the drive shaft;

a plurality of pulley tensioners engaging the outer side of a respective belt.

2. A power sander as defined in claim 1 further comprising:

said housing being bell shaped with a downwardly extending side wall and connectable to a vacuum motor for suction of saw dust up through said bell shaped housing;

said housing having a aperture for connection to a vacuum hose for allowing vacuuming of sawdust up through said housing and through said aperture;

a weighted metal plate attached to said inner bowl member, said weighted metal plate having apertures for allowing said pulley to extend therethrough;

said plate having an outer periphery spaced from said side wall of said housing to define a path for the vacuuming of said saw dust.

3. A power sander as defined in claim 2 further comprising:

each of said belts in vertically stacked on said drive shaft at a vertical position adjacent from one another;

each respective pulley is respectively vertically positioned to engage its respective belt horizontally from the engaging vertical position on the drive shaft;

each tensioner also is vertically positioned to a proper height to operably engage its respective belt.

4. A power sander as defined in claim 3 further comprising:

an inner side of said belts being cogged;

said drive shaft and said pulleys having respective cogged peripheries for creating a positive engagement with said inner side of said belts;

each pulley tensioner being a rotatable bearing that has its peripheral side wall frictionally engage the outer side of said respective belt;

the outer side of said belt being flat and being frictionally engaged with the respective pulley tensioner.

5. A power sander as defined in claim 4 further comprising:

a vacuum cleaner mounted to said an operating handle that is connected to said housing;

a vacuum hose operably extending from said vacuum cleaner and being resiliently flexible and stretchable from a rest length to an increased length;

the distal end of the hose having a shaped nozzle that can receive a hose coupling on the housing allowing said hose to be directly connected to said hose coupling without removal of said shaped nozzle for vacuuming sawdust out of the housing, and with said hose being detachable from said hose coupling to allow said shaped nozzle to be operable used.

6. A power sander as defined in claim 4 further comprising:

a vacuum cleaner mounted to said an operating handle that is connected to said housing; and said vacuum having a canister made of metal and grounded to the power sander.

7. A power sander as defined in claim 2 further comprising:

said weighted plate having notches at its outer periphery to create widened gaps with the housing to increase air flow therebetween.

8. A power sander as defined in claim 7 further comprising:

said housing having its side walls spaced within ⅜ inches from a sanding disc edge.

9. A power sander as defined in claim 1 further comprising:

said housing having handles mounted thereon near a front and rear portion thereof and extending upwardly therefrom;

a plurality of quick connect pins connect the housing to an operating handle.

10. A power sander for a wood floor comprising:

a housing;

a motor mounted to said housing and having a centrally positioned downwardly extending drive shaft;

an inner bowl member positioned within said housing and rotatably mounted on said drive shaft to allow rotation of said inner bowl with respect to both said housing and drive shaft;

a plurality of pulleys circumferentially spaced about said drive shaft and rotatably connected to said inner bowl member;

the axis of rotation of each pulley being parallel to the axis of rotation of said drive shaft;

each pulley constructed to have sander discs mounted thereon;

a plurality of belts, each belt mounted about the one pulley and engageably driven by the drive shaft;

said center drive shaft has a gear section, these gears are circumferentially spaced about said drive shaft and are rotatably mounted on said inner bowl member, are coplanar and operably engage said center gear section of said drive shaft;

said gears having respective pulley sections affixed thereto;

said pulley sections being coplanar with each other;

said plurality of pulleys being coplanar with each other and with said pulley sections;

said belts being coplanar and engage a pulley section of said respective gear and said pulleys.

11. A power sander as defined in claim 9 further comprising:

the inner side of said belts being cogged;

said pulley sections of said gears being cogged for creating a positive engagement with said inner section of said belts;

the pulley tensioner being a rotatable bearing that has its peripheral side wall frictionally engage the outer side of said respective belt;

the outer side of said belt being flat and being frictionally engaged with the pulley tensioner;

said rotatable bearings being co-planar.

12. A power sander having a housing, operating handle, and sanding discs rotatably mounted to an inner bowl within said housing, said power sander comprising:

a vacuum cleaner mounted to said operating handle;

a vacuum hose operably extending from said vacuum cleaner and being resiliently flexible and stretchable from a rest length to an increased length;

the distal end of the hose having a shaped nozzle that can receive a hose coupling on the housing allowing said hose to be directly connected to said hose coupling without removal of said shaped nozzle and bypassing said shaped nozzle for vacuuming sawdust out of the housing, and with said hose being detachable from said hose coupling to allow said shaped nozzle to be operably used.

13. A power sander as defined in claim 12 further comprising:

said vacuum having a canister made of metal and grounded to the power sander.

14. A power sander as defined in claim 1 further comprising:

said inner bowl being freely rotatable with respect to said housing;

all said pulleys being driven in one rotational direction to provide a torque on said pulleys which is transferred to said inner bowl to provide rotation of said inner bowl in an opposite rotational direction.

15. A power sander for a wood floor comprising:

a housing;

a motor mounted to said housing and having a centrally positioned downwardly extending drive shaft;

an inner bowl member positioned within said housing and rotatably mounted on said drive shaft to allow rotation of said inner bowl with respect to both said housing and drive shaft;

a plurality of pulleys circumferentially spaced about said drive shaft and rotatably connected to said inner bowl member;

the axis of rotation of each pulley being parallel to the axis of rotation of said drive shaft;

each pulley constructed to have sander discs mounted thereon;

a plurality of belts, each belt mounted about the one pulley and engageably driven by the drive shaft;

said inner bowl being freely rotatable with respect to said housing;

all said pulleys being driven in one rotational direction to provide a torque on said pulleys which is transferred to said inner bowl to provide rotation of said inner bowl in an opposite rotational direction.

* * * * *

UNITED STATES PATENT AND TRADEMARK OFFICE

CERTIFICATE OF CORRECTION

PATENT NO. : 6,595,838 B1
APPLICATION NO. : 09/911249
DATED : July 22, 2003
INVENTOR(S) : Palushi et al.

Figure 2:
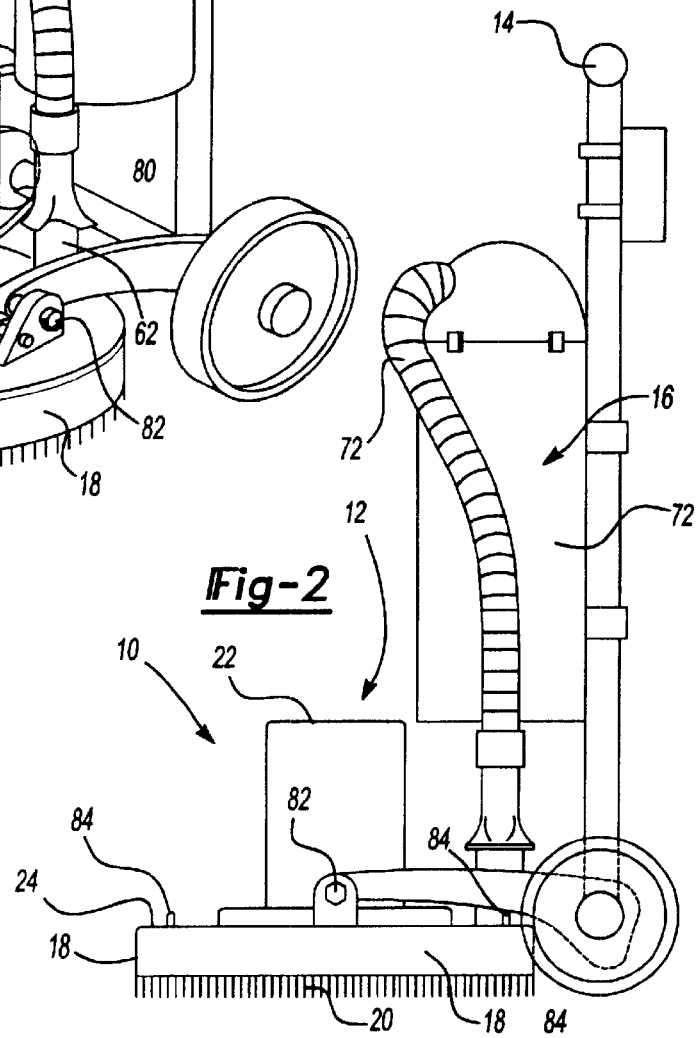
FIG. 2 is a side elevational view of the sander shown in FIG. 1.

It is certified that error appears in the above-identified patent and that said Letters Patent is hereby corrected as shown below:

Drawings, Sheet 1 of 7,
FIG. 1, add lead line to #80 as shown to attachment.
FIG. 2, delete duplicate #84.

Col. 2, Line 66, replace “ht” with --the--.
Col. 3, Line 9, after “Figure 3 is” insert --a--.

Col. 4,
Line 16, delete first occurrence of “be”.
Line 56, replace “an” with --a--.

Col. 6,
Claim 5, Line 32, delete “said”.
Claim 6, Line 47, delete “said”.

Signed and Sealed this

Twenty-fifth Day of September, 2007

JON W. DUDAS
*Director of the United States Patent and Trademark Office*

UNITED STATES PATENT AND TRADEMARK OFFICE

CERTIFICATE OF CORRECTION

PATENT NO. : 6,595,838 B1
APPLICATION NO. : 09/911249
DATED : July 22, 2003
INVENTOR(S) : Palushi et al.

It is certified that error appears in the above-identified patent and that said Letters Patent is hereby corrected as shown below:

Delete the title page and substitute therefore the attached title page.

Drawings, Sheet 1 of 7,
FIG. 1, add lead line to #80 as shown to attachment.
FIG. 2, delete duplicate #84.

Col. 2, Line 66, replace “ht” with --the--.
Col. 3, Line 9, after “Figure 3 is” insert --a--.

Col. 4,
Line 16, delete first occurrence of “be”.
Line 56, replace “an” with --a--.

Col. 6,
Claim 5, Line 32, delete “said”.
Claim 6, Line 47, delete “said”.

This certificate supersedes Certificate of Correction issued September 25, 2007.

Signed and Sealed this

Twenty-seventh Day of November, 2007

JON W. DUDAS
*Director of the United States Patent and Trademark Office*

(12) United States Patent
Palushi et al.

(10) Patent No.: US 6,595,838 B1
(45) Date of Patent: Jul. 22, 2003

(54) WOOD FLOOR SANDING MACHINE

(75) Inventors: Simon Palushi, Shelby Township, MI (US); Steven L. Permut, Huntington Woods, MI (US)

(73) Assignee: OnFloor Technologies, LLC, Newburgh, NY (US)

( * ) Notice: Subject to any disclaimer, the term of this patent is extended or adjusted under 35 U.S.C. 154(b) by 1 day.

(21) Appl. No.: 09/911,249

(22) Filed: Jul. 23, 2001

(51) Int. Cl.[7] ..... B24B 23/03
(52) U.S. Cl. ..... 451/350; 451/259
(58) Field of Search ..... 451/350, 351, 451/353, 259, 270, 271, 268, 269, 340, 344

(56) References Cited

U.S. PATENT DOCUMENTS

| | | | | | |
|---|---|---|---|---|---|
| 1,601,087 | A | | 9/1926 | Simpson | |
| 1,919,389 | A | * | 7/1933 | Myers | 144/119.1 |
| 1,928,390 | A | * | 9/1933 | Myers | 15/49.1 |
| 1,988,193 | A | * | 1/1935 | Edstrom | 15/98 |
| 2,171,060 | A | * | 8/1939 | De Spit | 299/41.1 |
| 2,300,138 | A | * | 10/1942 | Steele | 15/49.1 |
| 3,098,329 | A | | 7/1963 | Dunn | |
| 3,128,581 | A | | 4/1964 | Toselli | |
| 3,169,262 | A | | 2/1965 | Allen et al. | |
| 3,354,488 | A | | 11/1967 | Blide | |
| 3,721,048 | A | | 3/1973 | Rand | |
| 4,097,950 | A | * | 7/1978 | Satterfield | 15/385 |
| 4,150,456 | A | | 4/1979 | Alvarez et al. | |
| 4,182,001 | A | | 1/1980 | Krause | |
| 4,186,967 | A | * | 2/1980 | Kuhnonen | 299/25 |
| 4,319,434 | A | * | 3/1982 | Brejcha | 15/49.1 |
| 4,709,510 | A | | 12/1987 | Giovanni et al. | |
| 4,862,548 | A | * | 9/1989 | Sergio | 15/49.1 |
| 4,862,766 | A | | 9/1989 | Molders | |
| 5,054,245 | A | * | 10/1991 | Coty | 15/98 |
| 5,170,595 | A | * | 12/1992 | Wiand | 15/230 |
| 5,209,961 | A | | 5/1993 | Yokoi | |
| 5,228,301 | A | | 7/1993 | Tasikas | |
| 5,314,386 | A | | 5/1994 | Bide et al. | |
| 5,377,375 | A | | 1/1995 | Holman et al. | |
| 5,416,943 | A | * | 5/1995 | Weltikol et al. | 15/49.1 |
| 5,439,413 | A | | 8/1995 | Lagler | |
| 5,454,751 | A | | 10/1995 | Wiand | |
| 5,507,061 | A | | 4/1996 | Miyazaki | |
| 5,548,860 | A | * | 8/1996 | Weltikol et al. | 15/49.1 |
| 5,637,032 | A | | 6/1997 | Thysell et al. | |
| 5,765,250 | A | * | 6/1998 | Lee | 15/49.1 |
| 5,788,561 | A | * | 8/1998 | Pearlman et al. | 125/13.01 |
| 5,829,095 | A | | 11/1998 | Legatt et al. | |
| 5,863,241 | A | | 1/1999 | Rothschy | |
| 5,875,506 | A | | 3/1999 | Fluzanel | |
| 5,905,927 | A | | 5/1999 | Inoue et al. | |
| 6,148,476 | A | | 11/2000 | Legatt et al. | |
| 6,238,277 | B1 | * | 5/2001 | Duncan et al. | 451/271 |
| 6,331,138 | B1 | * | 12/2001 | Witters et al. | 451/259 |

OTHER PUBLICATIONS

Alto, American Sanders Technology, Alto U.S. Inc. 390 South Woods Mills Road, Chesterfield, MO 63017–3433 Catalog.
Lagler, Palo Duro Hardwoods, Inc. 4800 Lima Street, Denver Colorado 80239 Catalog.
Cimex International, 100 Straitman Street, Buffalo New York 14206 Catalog.
Innovatech, 19722 144th Avenue, NE Woodinville, WA 98072 Catalog.

* cited by examiner

*Primary Examiner*—Joseph J. Hail, III
*Assistant Examiner*—David B. Thomas
(74) *Attorney, Agent, or Firm*—Reising, Ethington, Barnes, Kisselle, P.C.

(57) ABSTRACT

A power sanding machine (10) has three circumferentially spaced cogged belts (40) that are under tension via bearings (36) to drive three discs (52). A grounded vacuum (16) with a metal canister (74) is mounted on the operating handle (14).

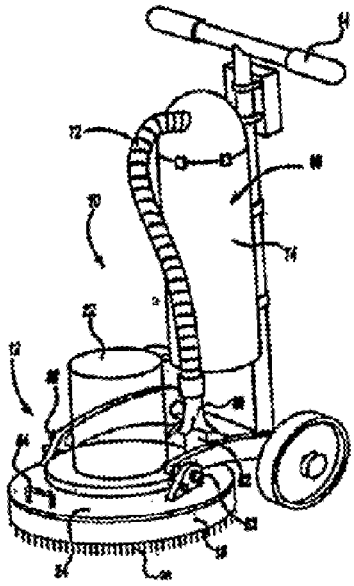

15 Claims, 7 Drawing Sheets